US010359224B2

(12) United States Patent
Jeong

(10) Patent No.: US 10,359,224 B2
(45) Date of Patent: Jul. 23, 2019

(54) REFRIGERATOR

(71) Applicant: LG ELECTRONICS INC., Seoul (KR)

(72) Inventor: Gyuyeon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 229 days.

(21) Appl. No.: 15/029,211

(22) PCT Filed: Nov. 20, 2015

(86) PCT No.: PCT/KR2015/012549
§ 371 (c)(1),
(2) Date: Apr. 13, 2016

(87) PCT Pub. No.: WO2016/089034
PCT Pub. Date: Jun. 9, 2016

(65) Prior Publication Data

US 2016/0327328 A1 Nov. 10, 2016

(30) Foreign Application Priority Data

Dec. 4, 2014 (KR) ..... 10-2014-0173105

(51) Int. Cl.
*F25D 11/00* (2006.01)
*F25D 17/04* (2006.01)
(Continued)

(52) U.S. Cl.
CPC ..... *F25D 17/047* (2013.01); *F25D 11/00* (2013.01); *F25D 17/042* (2013.01); *F25D 21/08* (2013.01);
(Continued)

(58) Field of Classification Search
CPC ..... F25D 17/047; F25D 17/042; F25D 11/00; F25D 21/08; F25D 23/065; F25D 23/025; F25D 17/0411; F25D 2400/02
(Continued)

(56) References Cited

U.S. PATENT DOCUMENTS 6,397,620 B1 6/2002 Kelly et al.
8,905,502 B2 12/2014 Kim
(Continued)

FOREIGN PATENT DOCUMENTS

CN 101162120 4/2008
CN 101280991 10/2008
(Continued)

OTHER PUBLICATIONS

International Search Report and Written Opinion dated Feb. 26, 2016 issued in Application No. PCT/KR2015/012549 (Full English Text).
(Continued)

*Primary Examiner* — Joseph F Trpisovsky
(74) *Attorney, Agent, or Firm* — Ked & Associates, LLP

(57) ABSTRACT

A refrigerator is disclosed. The refrigerator includes a cabinet, a freezing compartment defined in the cabinet, a door coupled to the cabinet so as to open and close the freezing compartment, and a pressure regulator mounted on the cabinet on as to allow an inside of the freezing compartment to communicate with an outside of the freezing compartment to reduce the difference in pressure when the door is opened, wherein the pressure regulator includes a connecting tube mounted at the position on the cabinet, an air introduction tube connected to the connecting tube outside of the cabinet, an opening device mounted in the air introduction tube so as to open and close an inlet of the air introduction tube, and a heater disposed around the connecting tube so as to heat
(Continued)

the connecting tube to thus eliminate frost accumulated on the inner surface of the connecting tube.

14 Claims, 10 Drawing Sheets

(51) Int. Cl.
*F25D 21/08* (2006.01)
*F25D 23/06* (2006.01)
*F25D 25/02* (2006.01)

(52) U.S. Cl.
CPC ..... *F25D 23/065* (2013.01); *F25D 25/025* (2013.01); *F25D 25/028* (2013.01); *F25D 2317/0411* (2013.01); *F25D 2400/02* (2013.01)

(58) Field of Classification Search
USPC ..... 62/265
See application file for complete search history.

(56) References Cited

U.S. PATENT DOCUMENTS

2004/0182107 A1* 9/2004 Kang ..... F25B 39/04 62/507
2005/0160754 A1* 7/2005 Hugh ..... F25D 17/047 62/275
2005/0206287 A1* 9/2005 House ..... A47B 96/021 312/408
2009/0064707 A1* 3/2009 Smith ..... F25D 11/006 62/465
2012/0266626 A1* 10/2012 Kim ..... F25D 17/047 62/404
2013/0105497 A1* 5/2013 Kim ..... F25D 17/047 220/592.09

FOREIGN PATENT DOCUMENTS

CN 203586665 5/2014
DE 3305764 A1 * 8/1984 ..... F25D 25/028
JP 2006-292352 A 10/2006
KR 20-1999-0038478 U 10/1999
KR 20-0322927 Y1 8/2003
KR 10-2010-0019078 A 2/2010
KR 10-2013-0045445 A 5/2013

OTHER PUBLICATIONS

European Search Report dated Oct. 11, 2017 issued in Application No. 15862154.0.
Chinese Office Action dated Feb. 2, 2018 issued in Application No. 201580002289.3 (with English translation).

* cited by examiner

[Fig. 1]
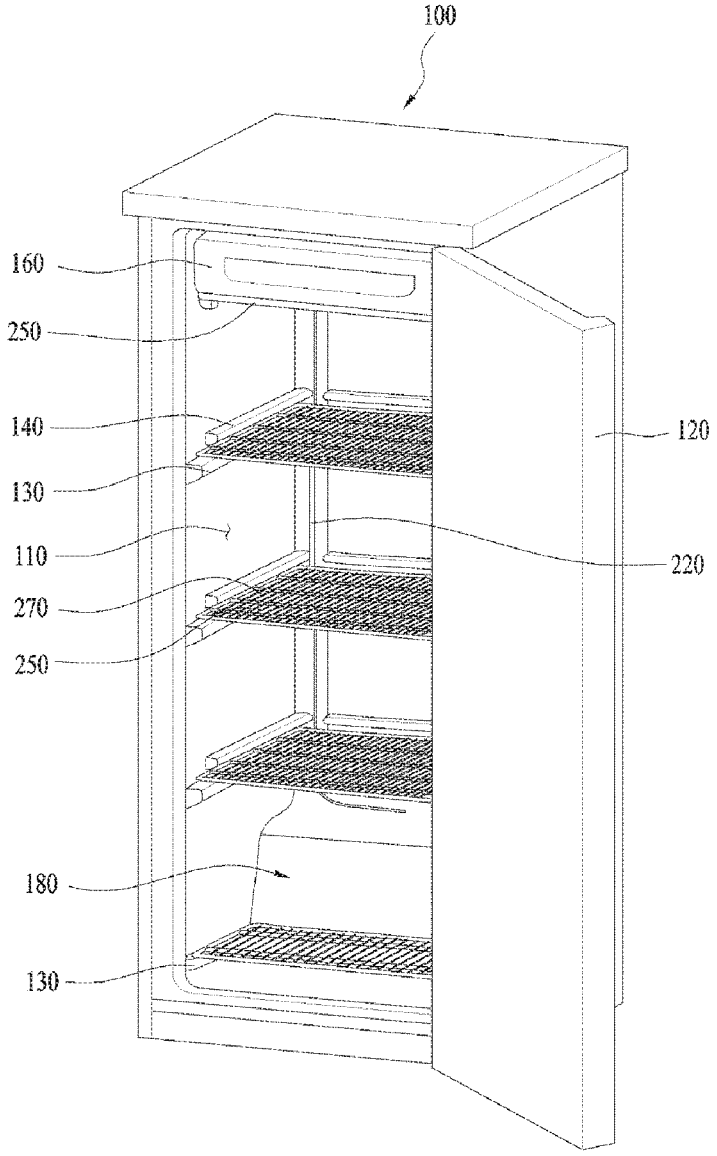

[Fig. 2]
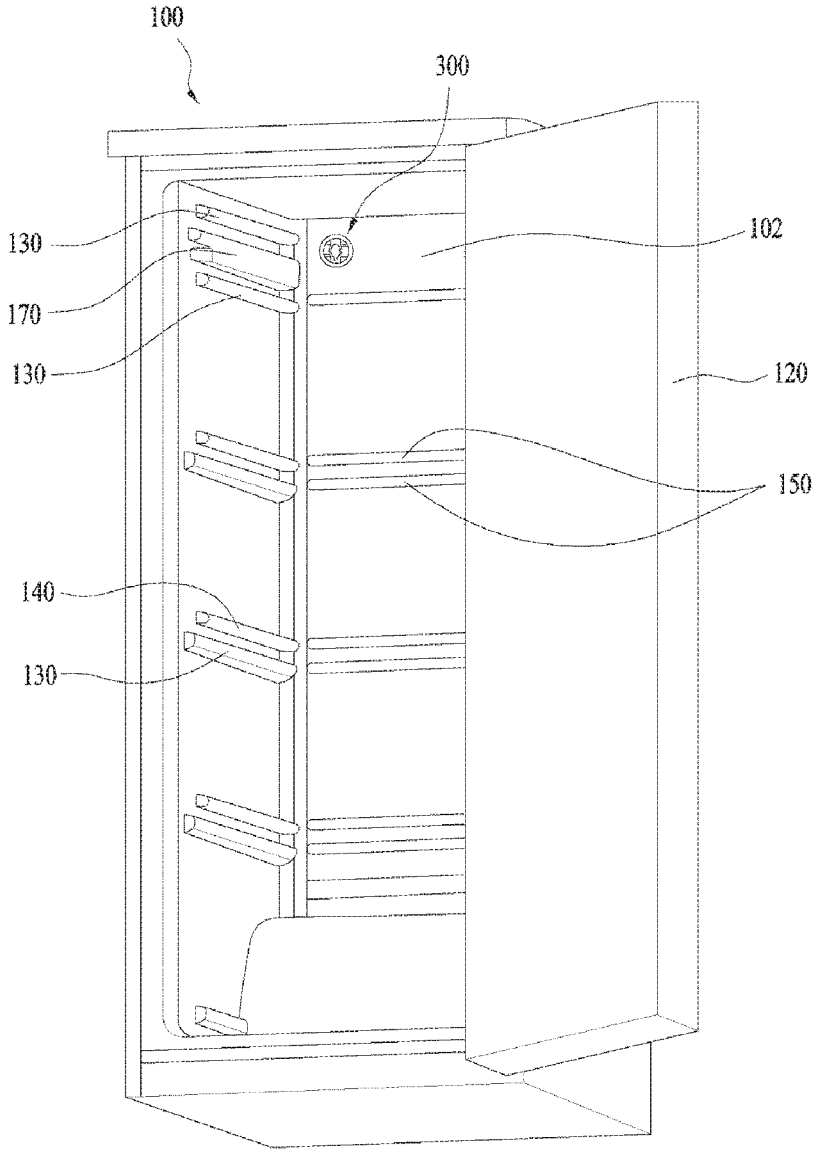

[Fig. 3]
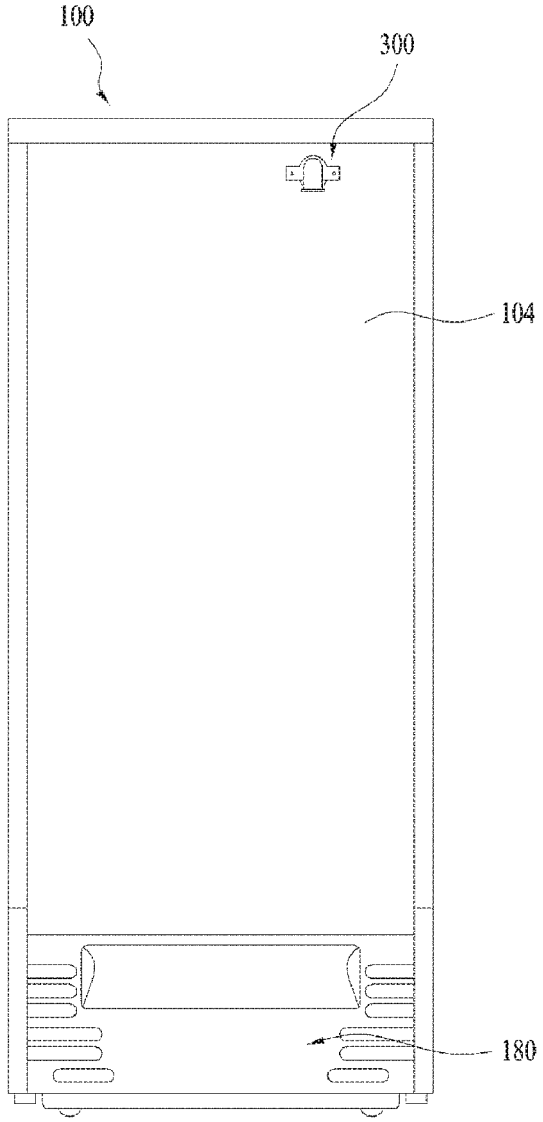

[Fig. 4]
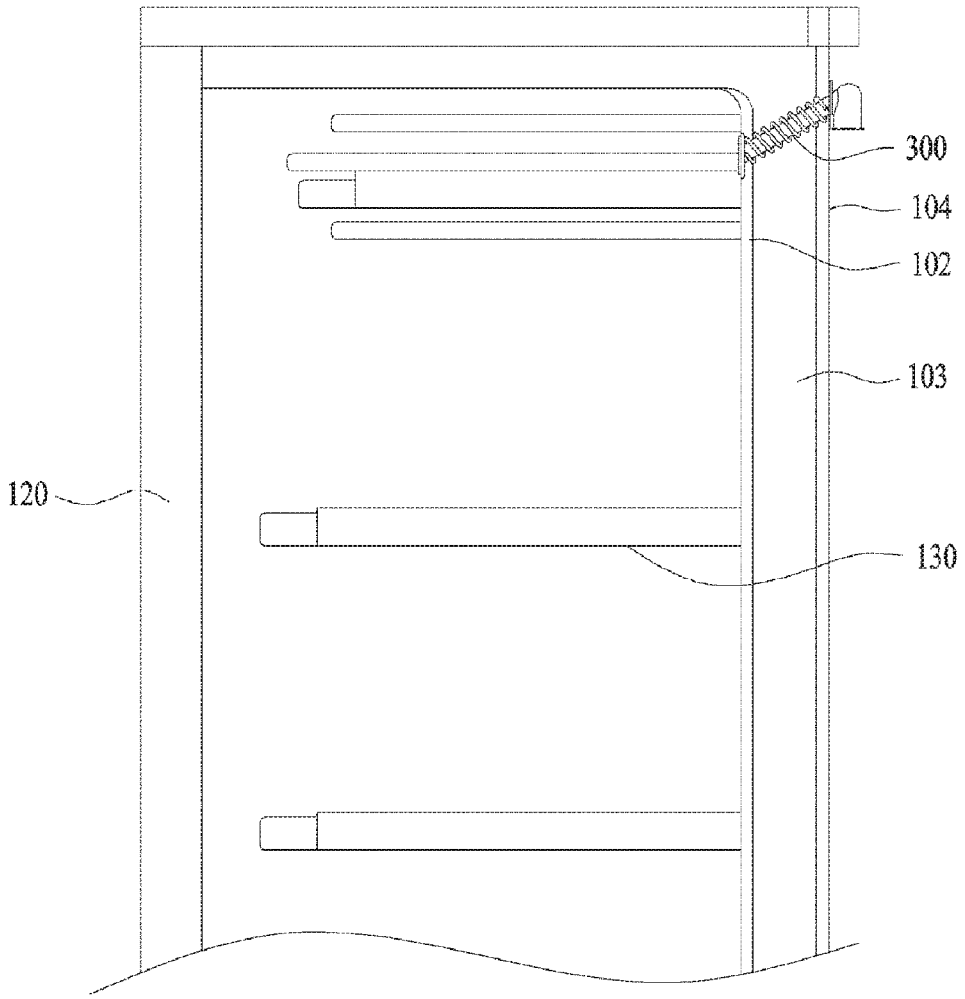

[Fig. 5]
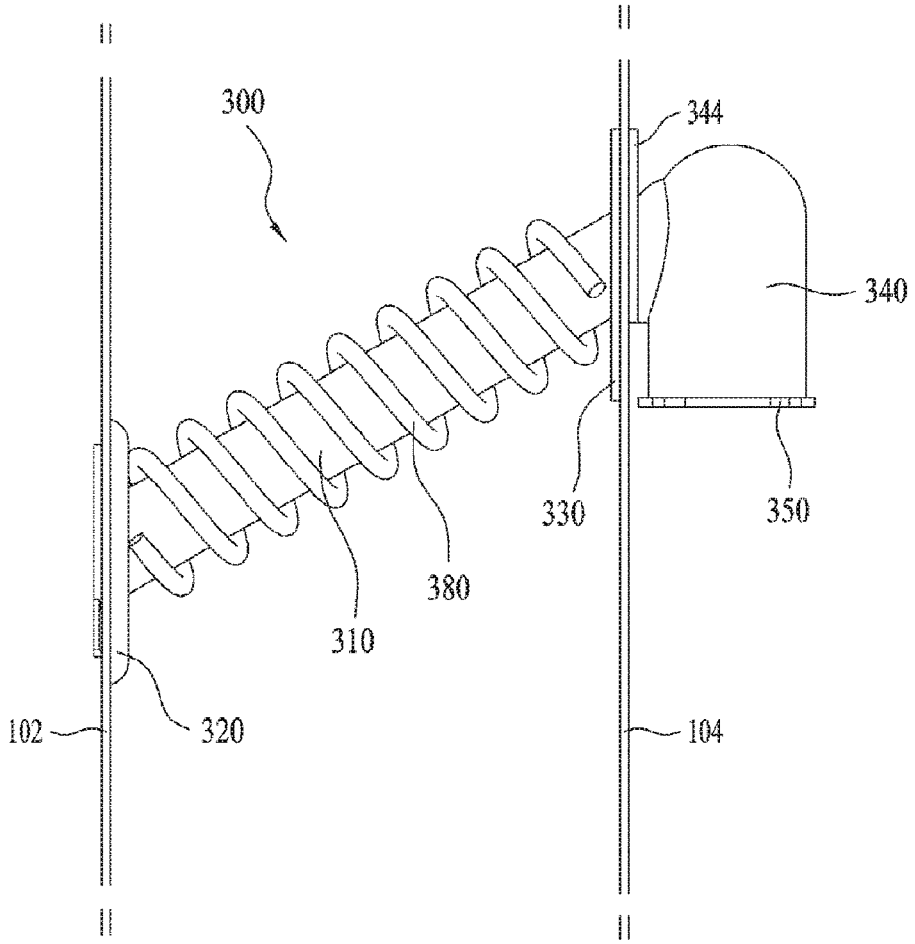

[Fig. 6]
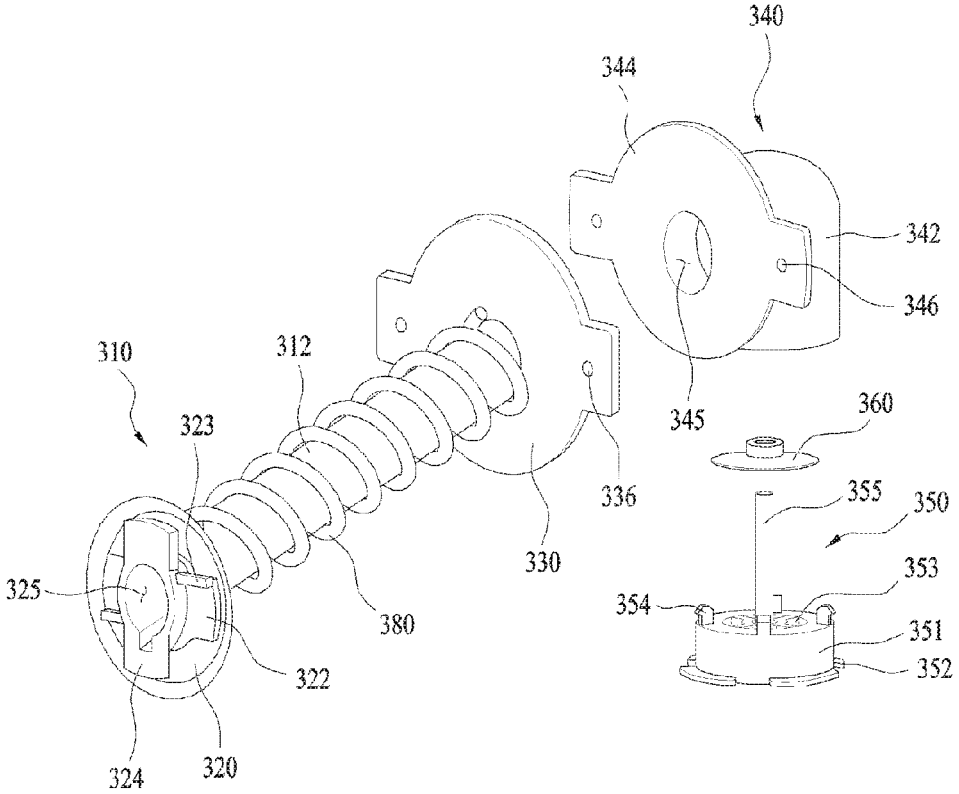

[Fig. 7]
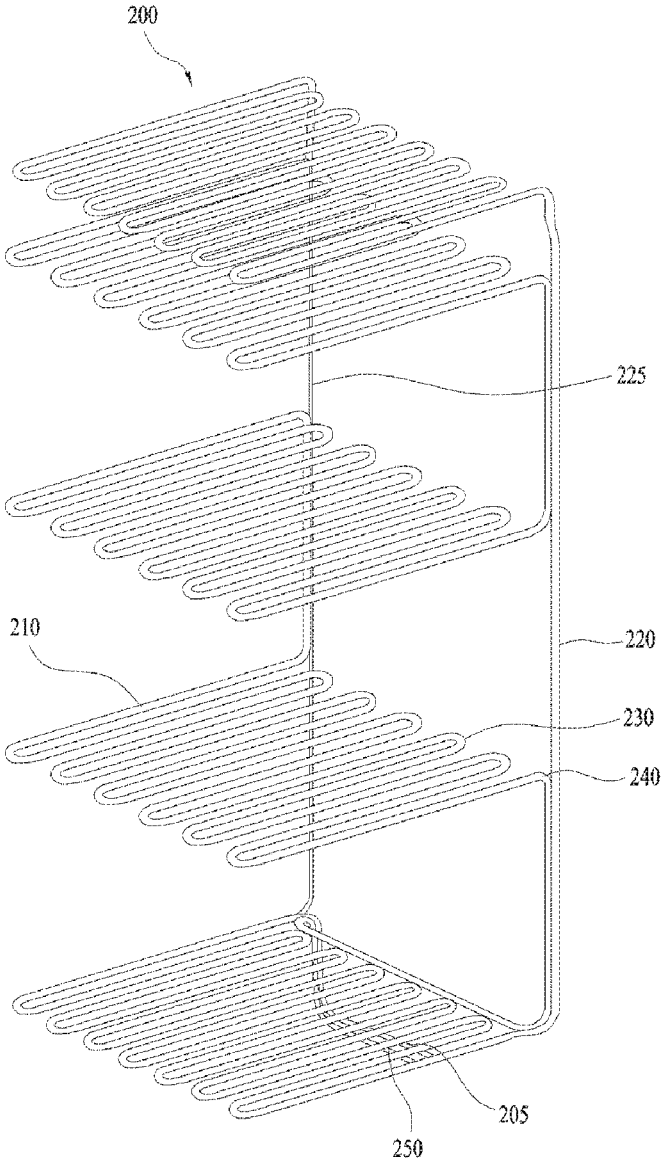

[Fig. 8]
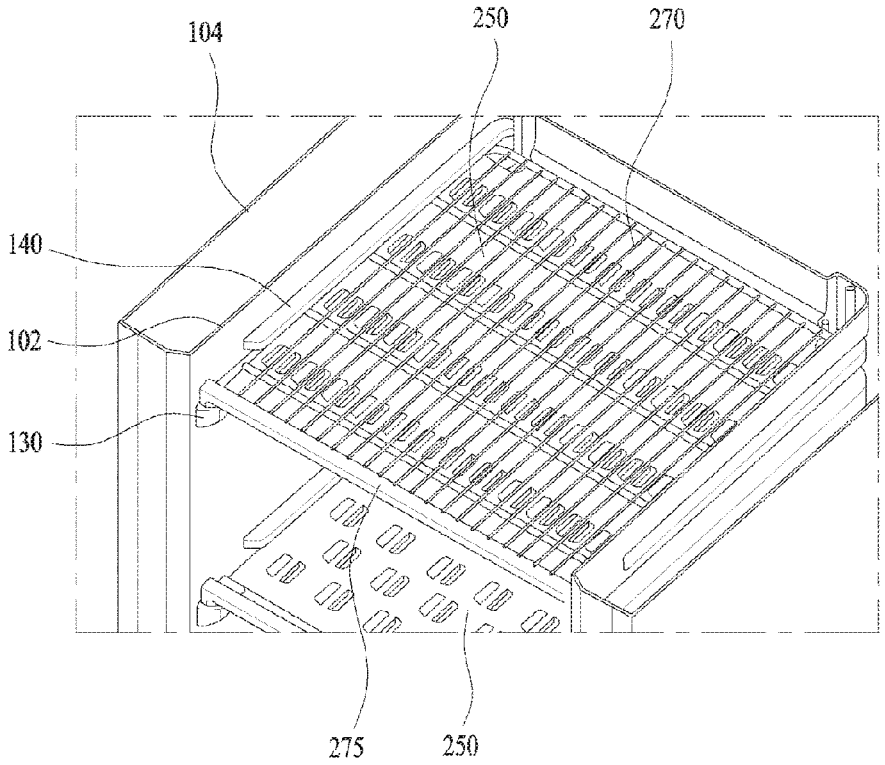
[Fig. 9]
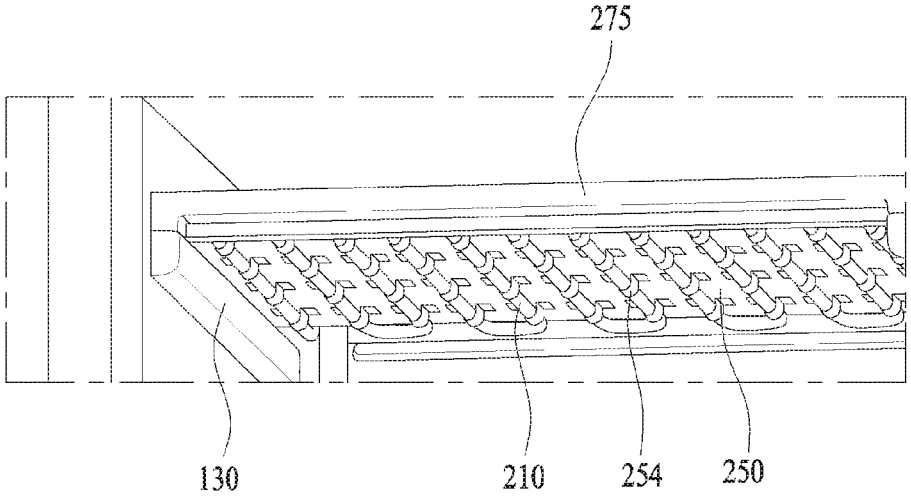

[Fig. 10]
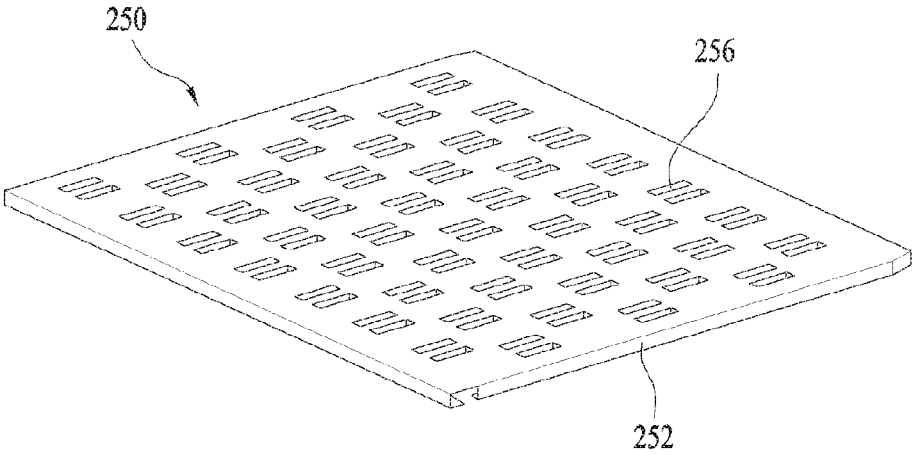
[Fig. 11]
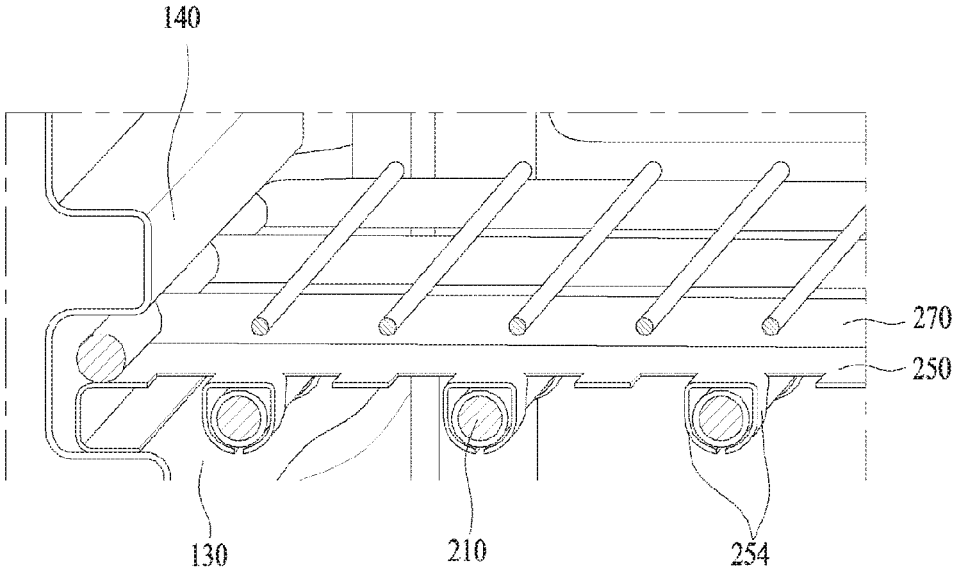

[Fig. 12]
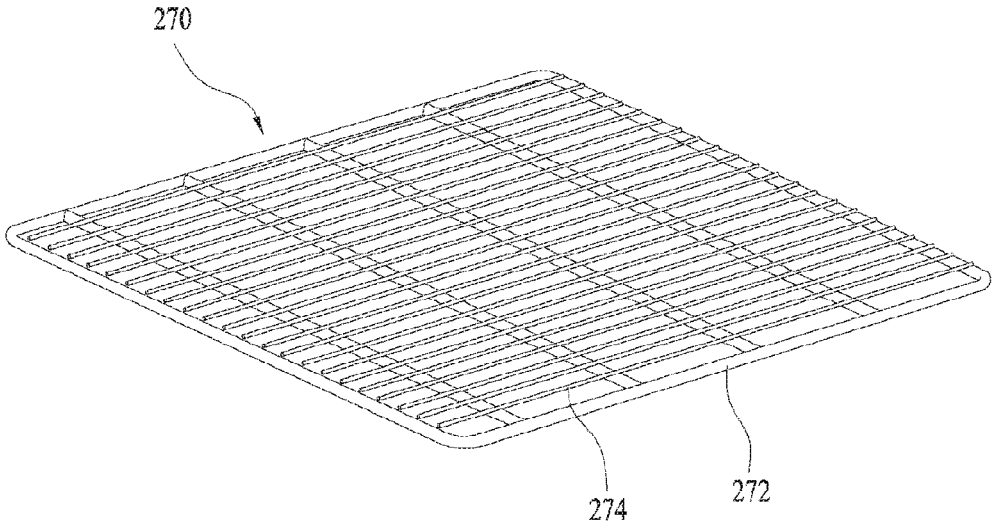
[Fig. 13]
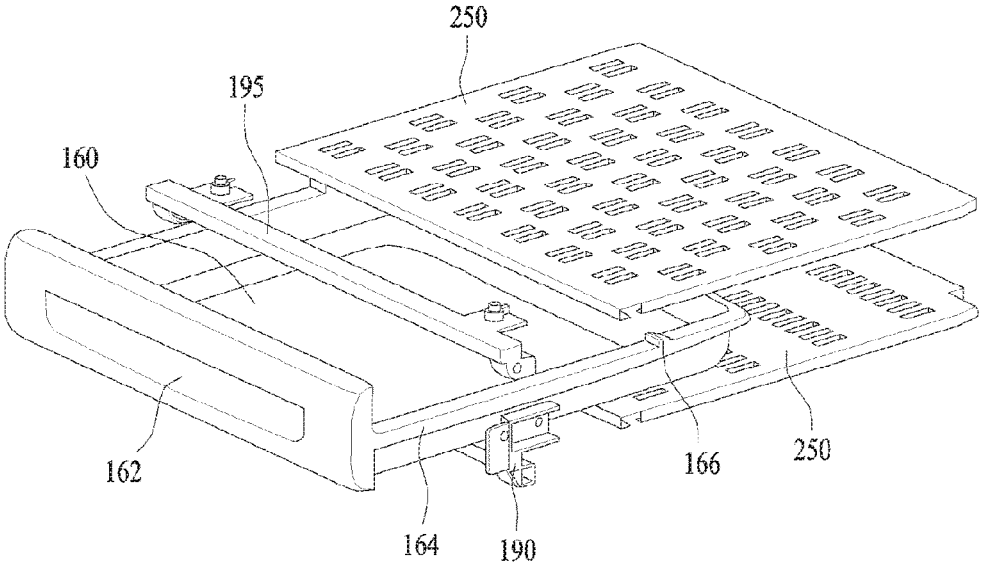

REFRIGERATOR

CROSS-REFERENCE TO RELATED PATENT APPLICATIONS

This application is a U.S. National Stage Application under 35 U.S.C. § 371 of PCT Application No. PCT/KR2015/012549, filed Nov. 20, 2015, which claims priority to Korean Patent Application No. 10-2014-0173105, filed Dec. 4, 2014, whose entire disclosures are hereby incorporated by reference.

TECHNICAL FIELD

The present invention relates to a refrigerator.

BACKGROUND ART

Generally, a refrigerator refers to a household electrical appliance, which is constructed to store foodstuffs in a storage space that is maintained at a lower temperature and is hermetically closed by a door. The refrigerator is capable of storing foodstuffs contained therein in an optimal state by cooling the inside of the storage space using cold air, which is created through heat exchange with refrigerant circulating in a refrigerating cycle.

Such refrigerators tend to increase in size and to have multiple functions in response to changes in trends and eating habits, and refrigerators having various structures for user convenience are being placed on the market.

The difference in temperature between the outside and inside of a general refrigerator is in a temperature range of about 20-40° C. In such a case, since the inside of the refrigerator, which is at the lower temperature, has a relatively low pressure, there is a problem whereby it is difficult to open the door of the refrigerator. In addition, the magnetic attraction created by a magnet provided in a gasket between the door and the cabinet of the refrigerator makes it even more difficult to open the door.

In order to solve such problems, conventional refrigerators, which adopts a so-called "easy open handle" structure that is designed to push the front surface of the cabinet when the door handle of the refrigerator is pulled, have been suggested.

However, since the easy open handle structure requires a large number of parts, there are problems in that the construction becomes complicated and manufacturing costs are increased.

In connection therewith, Korean Unexamined Patent Application Publication No. 10-2013-0045445 discloses a refrigerator, which includes a pressure regulator designed to eliminate the difference in pressure between the inside and outside of the refrigerator by allowing the inside to communicate with the outside when it is desired to open the door of the refrigerator.

However, since the difference in pressure between the inside and outside of the refrigerator is great even in the case in which the pressure regulator is adopted, there is a problem whereby frost is generated on the inner surface of a connecting tube, which connects the inside and outside of the refrigerator.

When a large amount of frost is created, the connecting tube is blocked, and thus the function of eliminating the pressure difference may be not fulfilled. Accordingly, there is the necessity to periodically remove the accumulated frost.

In addition, in the case in which a storage compartment in a cabinet is a freezing compartment, which is maintained at a temperature below zero, since the difference in temperature between the inside and outside of the refrigerant is even greater, the necessity to eliminate the pressure difference and to remove frost using the pressure regulator may be further increased.

In the case of a direct cooling-type evaporator, a refrigerant pipe of the evaporator is disposed in a storage compartment, and the refrigerant pipe performs direct heat exchange with ambient air, thereby cooling the storage compartment.

In the case of freezing compartment having a large space, a refrigerant pipe of an evaporator must be disposed so as to efficiently cool all of the areas inside the freezing compartment, thereby necessitating a structure capable of mounting and supporting a refrigerant pipe, the structure having a shape suitable for the disposition of the refrigerant pipe.

DISCLOSURE OF INVENTION

Technical Problem

Therefore, the present invention has been made in view of the above problems, and it is an object of the present invention to provide a refrigerator that is constructed to eliminate the difference in pressure between the inside and outside of the refrigerator when the door is opened, thereby making it easy to open the door and removing frost accumulated in a pressure regulator.

It is another object of the present invention to provide a refrigerator in which a refrigerant pipe of a direct cooling-type evaporator is disposed throughout a freezing compartment, which is able to efficiently and uniformly transfer cold air generated from the refrigerant pipe and to securely support the refrigerant pipe.

Solution to Problem

In one aspect of the present invention, the object of the present invention can be achieved by providing a refrigerator including a cabinet, a freezing compartment defined in the cabinet, a door coupled to the cabinet so as to open and close the refreezing compartment, and a pressure regulator mounted at a predetermined position on the cabinet so as to allow the inside of the freezing compartment to communicate with the outside of the freezing compartment to reduce the difference in pressure when the door is opened, wherein the pressure regulator includes a connecting tube mounted at the position on the cabinet, an air introduction tube, which is connected to the connecting tube outside the cabinet, an opening device mounted in the air introduction tube so as to open and close an inlet of the air introduction tube, and a heater disposed around the connecting tube so as to heat the connecting tube to thus eliminate frost generated on the inner surface of the connecting tube.

The heater may be disposed to surround the outer surface of the connecting tube.

The connecting tube may be mounted such that one end of the connecting tube that is outside of the cabinet is positioned at a higher level than the other end of the connecting tube that is inside the cabinet.

The cabinet may include an outer case defining the appearance of the refrigerator, an inner case, which is coupled to the outer case and has the freezing compartment therein, and a thermal insulator disposed between the outer case and the inner case, wherein the connecting tube is mounted so as to be buried in the thermal insulator.

The connecting tube may include a first flange, which is provided at one end of the connecting tube and is supported by the outer surface of the inner case, and a second flange, which is provided at the other end of the connecting tube and is supported by the outer surface of the outer case.

The connecting tube may further include a rotatable member, which is rotatably coupled to the first flange such that the rotatable member is spaced apart from the outer surface of the first flange and the inner case is disposed between the rotatable member and the first flange.

The connecting tube may further include a coupling member, which is coupled to the first flange in a state of being spaced apart from the outer surface of the first flange so as to guide the rotation of the rotatable member and limit the rotating angle of the rotatable member.

The air introduction tube may include a tube body vertically disposed outside the outer case, and a tube flange, which is fixedly coupled to the second flange outside the outer case by means of a fastening member penetrating the outer case.

The opening device may include a valve cap, which is fitted into the tube body and has a communication hole, a guide shaft extending upward from the center of the valve cap, and a shutter, which is moved along the guide shaft so as to selectively open and close the communication hole.

The valve cap may include a plurality of hooks, which extend from an edge of an upper end of the valve cap and are caught by grooves formed in the inner surface of the tube body.

The refrigerator may further include a drawer slidably mounted in the upper part of the freezing compartment, the pressure regulator being disposed behind the drawer.

In another aspect of the present invention, provided herein is a refrigerator including a cabinet, a freezing compartment defined in the cabinet, a shelf guide provided on the inner surface of the freezing compartment, a support plate supported by the shelf guide, an evaporator constituted by a refrigerant pipe supported by the support plate, and a shelf mounted on the support plate.

The support plate may include lateral side supports, which extend downward from both lateral side edges of the support plate to surround the refrigerant pipe and are supported by the shelf guide.

The support plate may further include a plurality of support holders, which extend downward from the lower surface of the support plate to support the refrigerant pipe.

The shelf guide may include a pair of lower rails for supporting lower surfaces of the lateral side supports of the support plate, and a pair of upper rails for supporting the upper surface of the shelf.

The shelf guide may further include a rear rib, which is provided on the rear surface of the freezing compartment to support the support plate.

The shelf may include a core member, which is prepared by bending and welding a metal wire, and a coating material applied to the outer surface of the core member.

The refrigerator may further include a pressure regulator, which is mounted at a predetermined position on the cabinet so as to allow the inside of the freezing compartment to communicate with the outside of the freezing compartment in order to reduce the difference in pressure when the door is opened.

The pressure regulator may include a connecting tube mounted on the position on the cabinet, an air introduction tube, which is connected to the connecting tube outside the cabinet, an opening device mounted in the air introduction tube so as to open and close an inlet of the an introduction tube, and a heater disposed around the connecting tube so as to heat the connecting tube to thus eliminate frost generated on the inner surface of the connecting tube.

Advantageous Effects of Invention

According to the present invention, when the door is opened, the difference in pressure between the inside and outside of the refrigerator is eliminated, thereby making it easy to open the door and removing frost generated in the pressure regulator.

In addition, in a refrigerator in which a refrigerant pipe of a direct cooling-type evaporator is disposed throughout a freezing compartment, cold air generated from the refrigerant pipe is efficiently and uniformly transferred, and the refrigerant pipe is securely supported.

Furthermore, since the evaporator is disposed such that almost none thereof is exposed to a user when the door is opened, the refrigerator exhibits a neat appearance.

In addition, since the support plate for supporting the refrigerant pipe is provided thereon with the shelf, which is made of a material different front the support plate, it is possible to prevent stored objects from sticking to the shelf.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view of the refrigerator according to the present invention;

FIG. 2 is a perspective view of the refrigerator shown in FIG. 1, from which an evaporator, shelves and a drawer, disposed at the upper part of the refrigerator, are removed;

FIG. 3 is a rear view of the refrigerator according to the present invention;

FIG. 4 is a side cross-sectional view of the refrigerator according to the present invention, which is taken along a line extending through a pressure regulator;

FIG. 5 is a perspective view of the pressure regulator;

FIG. 6 is an exploded perspective view of the pressure regulator;

FIG. 7 is a perspective view of the evaporator;

FIG. 8 is a perspective view of the support plate and the shelf mounted on the shelf guide, which is partially broken away;

FIG. 9 is a fragmentary perspective view of the evaporator mounted on the support plate;

FIG. 10 is a perspective view of the support plate;

FIG. 11 is a perspective view showing support holders for mounting the evaporator on the support plate, which is partially broken away;

FIG. 12 is a perspective view of the shelf; and

FIG. 13 is an exploded perspective view of an upper drawer and support plates disposed on and under the upper drawer.

BEST MODE FOR CARRYING OUT THE INVENTION

Hereinafter, a preferred embodiment of the present invention is described in detail with reference to the accompanying drawings.

As shown in FIG. 1, a refrigerator according to the present invention includes a rectangular parallelepiped cabinet 100 having an open front face and a door 120 hingedly mounted on the lateral side of the cabinet 100.

The cabinet 100 is provided therein with a freezing compartment 110, which is maintained at temperature below zero.

The freezing compartment 110 contains foodstuffs and maintains the foodstuffs at a temperature below zero. In this description, the freezing compartment 110 refers to a storage space that is maintained at temperature below zero, but does not refer to the continual maintenance of foodstuffs in a frozen state.

For example, alcoholic liquor, such as distilled spirit, is a liquid that does not freeze even at a temperature of −1-−5° C.

Accordingly, the freezing compartment is merely a storage space for storing foodstuffs at a temperature below zero, but is not necessarily a space for maintaining foodstuffs in a frozen state at all times.

Although the refrigerator 110 according to the present invention mainly stores alcoholic beverage such as distilled spirits, beer and hard liquor, the refrigerator 110 may store any foodstuffs without limitation as long as the foodstuffs are usually stored at a temperature of −30° C.-+3° C.

The storage space in the freezing compartment 110 may be partitioned by means of a plurality of shelves 270 and a plurality of support plates 250.

A refrigerant pipe of an evaporator is disposed below the support plates 250, and the refrigerant pipe 220 is shown in FIG. 1 as being partially exposed.

The support plates 250 and the shelves 270 may be mounted on the cabinet 100 by means of shelf guides.

As shown in FIG. 2, each of the shelf guides may include a pair of lower rails 130 for supporting the lower surface of the support plate 250 and a pair of upper rails 140 for supporting the lateral edge of the upper surface of the shelf.

Referring to FIG. 1, since a machine room 180 is disposed behind the lowermost shelf 270 among the plurality of shelves, the lowermost shelf 270 has a smaller anteroposterior length than other shelves.

Since the refrigerant pipe of the evaporator 200 extends only to the support plate 250, which is positioned immediately above the machine room 180, only the lowermost shelf 270 is mounted on the bottom of the freezing compartment 110 without the support plate.

The remaining three shelves 270, which are disposed above the machine room 180, may be slidably mounted of the cabinet.

The upper rails 140 support the lateral edge of the upper surface of the shelf 270 such that the shelf 270 does not drop from the front ends of the lower rails 130 due to the momentum caused by its own weight and the weight of stored objects placed thereon when the shelf 270 is drawn forwards.

A drawer 160 may be slidably mounted in the uppermost space of the freezing compartment 110.

The drawer 160 may be provided at the upper end as well as at the lower end thereof with the support plate 250 on which the refrigerant pipe of the evaporator is mounted.

The support plates 250, which are disposed on and under the drawer 160, may be mounted on the respective pairs of lower rails 130 provided on the inner surface of freezing compartment 110. Drawer guides 170 for supporting the drawer 160 may further be provided on the inner surface of the freezing compartment 110, in addition to the lower rails 130.

As shown in FIG. 2, the rear surface of the freezing compartment 110 may be also be provided with a rear rib 150 for supporting the support plate 250.

Since the support plate 250 must support not only the refrigerant in the evaporator but also the weight of the shelf 270 and stored objects placed thereon, the support plate. 250 may be supported by both the lower rails 130 and the rear rib 150 in order to increase the ability to support the support plate.

As shown in FIGS. 2 to 4, the refrigerator according to the present invention includes a pressure regulator 300, which is mounted at a predetermined position on the cabinet 100 such that the outside of the freezing compartment 110 communicates with the inside of the freezing compartment 110 so as to reduce the difference in pressure between the outside and inside of the freezing compartment 110 when the door 120 is opened.

The pressure regulator 300 is installed through the inner case 102 and the outer case 104 of the cabinet 100. The pressure regulator 300 allows the outside of the refrigerator to communicate with the inside of the refrigerator so as to eliminate the difference in pressure therebetween and to enable the door 120 to be easily opened only when the door 120 is pulled and opened by a user.

As shown in FIGS. 5 and 6, the pressure regulator 300 may include a connecting tube 310, which penetrates the cabinet 100 at a predetermined position, an air introduction tube 340, which is connected to the connecting tube 310 at the outside of the cabinet 100, an opening device, which is disposed in the air introduction tube 340 so as to open and close the inlet of the air introduction tube 340, and a heater 380, which is disposed around the connecting tube 310 and so as to heat the connecting tube 310 to thus eliminate the frost generated on the inner surface of the connecting tube 310.

The connecting tube 310 may be configured to have a circular pipe shape. The inner case 102 and the outer case 104 of the cabinet 100 may be provided with respective through holes, which communicate respectively with opposite ends of the connecting tube 310.

A thermal insulator may be disposed between the inner case 102 and the outer case 104 such that the connecting tube 310 is buried in the thermal insulator 103.

The connecting tube 310 is preferably mounted such that the outer end of the connecting tube 310 is positioned at a higher level than the inner end of the connecting tube 310. In other words, the connecting tube 310 may be obliquely disposed such that the end of the connecting tube 310 that is connected to the outer case 104 is positioned at a higher level than the end of the connecting tube 310 that is connected to the inner case 102.

Consequently, it is possible to prevent defrost water, which is generated by the heater 380, from dropping outside the cabinet 100, and to introduce the water into the drawer 250 in the freezing compartment 110.

The heater 380 may be configured to have a spiral wire shape surrounding the outer surface of the connecting tube 310.

The heater 380 may eliminate frost, which is generated on the inner surface of the connecting tube 310, by selectively heating the connecting tube 310.

The connecting tube 310 may include a connecting tube body 312, which is obliquely positioned as described above, a first flange 320, which is provided on one end of the connecting tube body 312 and is supported by the outer surface of the inner case 102, and a second flange 330, which is provided on the other end of the connecting tube body 312 and is supported by the inner surface of the outer case 104.

Since the connecting tube 310 is mounted in the inclined state, the first flange 320 and the second flange 330 are integrally connected to the connecting tube body 312 in the state of being inclined at an oblique angle relative to the connecting tube body 312 rather than being perpendicular to the connecting tube body 312.

The first flange 320 is mounted on the outer surface of the inner case 102 in a state of being in close contact therewith, and the second flange 330 is mounted on the inner surface of the outer case 104.

As shown in FIG. 6, the first flange 320 may further be provided at the outer side thereof with a rotatable member 324, which is spaced apart from the first flange 320 and is rotatably mounted on the first flange 320.

The rotatable member 324 communicates with the inside of the connecting tube body 312 through a hole 325 formed therethrough.

The inner case 102 is disposed between the first flange 320 and the rotatable member 324.

The rotatable member 324 may be elongated horizontally, and the inner case 102 may be formed with a long hole, which has the same shape as the rotatable member 324 and a slightly larger size than the rotatable member 324 such that the rotatable member 324 passes through the long hole.

Accordingly, when the rotatable member 324 is inserted into the long hole formed in the inner case 102 and is rotated, the inner case 102 is secured between the rotatable member 324 and the first flange 320 in a pressed state.

Unlike the manner in which the rotatable member 324 is directly mounted on the first flange 320, the rotatable member 324 may be rotatably mounted on a coupling member 322, which is secured in the state of being spaced apart from the outer surface of the first flange 320.

The coupling member 322 is preferably provided at a predetermined location thereof with a stopper protrusion 323 so as to limit the angular range of rotation of the rotatable member 324.

By virtue of the stopper protrusion 323, the rotatable member 324 may be rotated between a position at which the rotatable member 324 overlaps the coupling member 322 and a position at which the rotatable member 324 is rotated from the overlapping position to a right angle.

The second flange 330 may be sized larger than the first flange 320, and may be secured to the inner surface of the outer case 104 by means of fastening members such as screws.

To this end, the second flange 330 may be provided with at least two screw holes 336, and the outer case 104 may also be provided with through holes (not shown) through which screws pass.

The air introduction tube 340 is mounted on the outer surface, in particular, the rear surface of the outer case 104.

The air introduction tube 340 may include a tube body 342, which is positioned vertically outside of the outer case 104, and a tube flange 344, which is fixedly coupled to the second flange 330 at the outer surface of the outer case 104 by means of a fastening member (not shown) which passes through the outer case 104.

The tube body 342 is configured to have a pipe shape, which is positioned to be perpendicular to the ground, and the tube body 342 is closed at the upper end thereof and is open at the lower end thereof.

The tube body 342 has formed in the side surface thereof a hole 345, which communicates with the hole in the connecting tube body 312.

The tube flange 344 may be configured to have a shape that extends radially from the hole 345 in the tube body 342 so as to have a shape corresponding to the shape of the second flange 330, and may be integrally connected to the tube body 342.

The tube flange 344 may also have two screw holes 346 so that the second flange. 330 of the connecting tube 310, the outer case 104 and the tube flange 344 of the air introduction tube 340 can be coupled to one another by means of screws.

The tube body 342 may be provided therein with the opening device so as to selectively open and close the hole in the lower end of the tube body 342.

The opening device may include a valve cap 350, which is fitted into the lower end of the tube body 342 and has a communication hole 353 therein, a guide shaft 355, which extends upwards from the center of the valve cap 350, and a shutter 360, which is movable vertically along the guide shaft 355 so as to selectively open and close the communication hole 353.

The valve cap 350 is fitted into the tube body 342 through the lower end hole in tube body 342, and has the communication hole 353 formed in the center thereof.

The valve cap 350 includes a valve cap body 351, which has an outer diameter almost identical to the inner diameter of the tube body 342. Accordingly, when the valve cap body 351 is fitted into the tube body 342, the outer surface of the valve cap body 351 may be mounted in the tube body 342 in a close contact state.

The valve cap 350 may be provided at the lower end thereof with a flange 352, which has a larger diameter than the inner diameter of the tube body 342 such that the flange 352 is caught by the lower end of the tube body 342 and is thus exposed to the outside.

The flange 352 serves to enable the valve cap 350 to be securely fitted in the tube body 342 and to seal the gap between the outer surface of the valve cap body 351 of the valve cap 350 and the inner surface of the tube body 342 so as to prevent air from leaking through the gap.

The valve cap 350 may be integrally provided at the peripheral edge of the upper surface thereof with a plurality of hooks 354, which extend upward and then radially.

Accordingly, the inner surface of the tube body 342 may be provided with grooves (not shown) in which the plurality of hooks 354 are caught when the valve cap 350 is mounted.

Since the hooks 354 are flexibly deformable, it is very easy to insert the valve cap 350 into the tube body 342 for assembly.

The valve cap 350 may be integrally provided with the guide shaft 355, which extends upward from the center of the valve cap 350.

The shutter 360 has a central hole through which the guide shaft 355 passes, and is slidably fitted over the guide shaft 355.

All of the connecting tube 310, the air introduction tube 340, the valve cap 350 and the shutter 360 are made of a plastic material. In particular, the valve cap 350 and the shutter 360 are preferably made of a material having low frictional force for the purpose of easy sliding action therebetween.

In order to ensure easy sliding of the shutter 360, the central hole in the shutter 360 may have an inner diameter slightly larger than the outer diameter of the guide shaft 355.

If the inner diameter of the central hole in the shutter 360 is much larger than the outer diameter of the guide shaft 355, the shutter 360 may be inclined while being moved vertically. Therefore, the gap provided between the central hole and the guide shaft 355 is preferably small.

The shutter 360 preferably has a varying thickness, which is larger at the center region than at the peripheral edge region thereof.

By virtue of the varying thickness having a larger value at the center, it is possible to prevent the shutter 360 from being inclined while being moved vertically.

The pressure regulator 300 is preferably mounted on the rear surface of the cabinet 100 behind the drawer 160 such that the pressure regulator 300 is not exposed to the user when the door 120 is opened by the user.

The mounting structures of the evaporator 200 and the shelves 270 will now be described in detail.

As shown in FIG. 7, the evaporator 200, which is of a direct cooling type, includes the refrigerant pipe, which is arranged in such a fashion as to uniformly transfer cold air to the space inside the freezing compartment 110.

The refrigerant pipe of the evaporator 200 has an inlet pipe 205 and an outlet pipe 250, which are positioned at the lower end thereof and are connected to the machine room 180, which accommodates the compressor and the condenser.

The refrigerant pipe of the evaporator 200 may include, when the entire refrigerant pipe is divided based on a bent portion, a plurality of horizontal sections 210, a plurality of vertical sections 220, which are perpendicular to the horizontal sections 210, first connecting sections 230, which are disposed between the horizontal sections 210 and are bent from the horizontal sections 210 at an angle of 180°, and second connecting sections 240, which are disposed between the horizontal sections 210 and the vertical sections 220 and are bent from the horizontal or vertical sections at an angle of 90°.

The refrigerant pipe may be constructed by bending a single aluminum pipe such that all of the various kinds of pipe sections are integrally connected to one another.

The refrigerant pipe of the evaporator 200 may include a total of five groups of horizontal sections 210, which are mounted on the support plates 250.

Among the five groups of horizontal sections, the two uppermost groups of horizontal sections 210 are disposed on and under the drawer 160.

Since the refrigerant pipe is disposed on and under the drawer 160, the space inside the drawer 160 may be maintained at a temperature lower than the other storage spaces in the freezing compartment 110.

As described above, the inner surface of the cabinet 100 is provided at predetermined levels with the shelf guides, that is, the lower rails 130 and the upper rails 140.

The support plates 250 are mounted on the lower rails 130 and are supported thereby. Each of the support plates 250 may have the overall shape of a rectangular plate.

The support plates 250 serve to hold and support the refrigerant pipe of the evaporator 220 disposed therebeneath.

The refrigerant pipe of the evaporator 200 may be made of an aluminum material having thermal conductivity, and the support plates 250 may also be made of metal such as aluminum or stainless steel in order to ensure the efficient transfer of cold air in the evaporator 200 and sufficient supporting strength.

However, when the support plates 250 are made of a metal material, there may be problems in that frost is easily generated in the freezing compartment 110 and stored objects are apt to stick thereto.

Hence, according to the present invention, the shelves 270, which are made of a non-metallic material are mounted on the support plates 250 so as to prevent direct contact between the support plates 250 and stored objects placed thereon.

Each of the support plates 250 preferably includes lateral side supports 252, which extend from both lateral side edges thereof to surround the refrigerant pipe and are supported by the shelf guides.

Each of the lateral side supports 252 may be bent to have a "⊂"-shaped cross section, and may be supported at the lower ends thereof by the lower rails 130 in the state of being in contact therewith.

The shelf 270 preferably includes a core member, which is prepared by bending and welding a metal wire, and a coating material applied to the outer surface of the core member.

As shown in FIG. 12, the shelf 270 may include a support wire member 272 composed of a rectangular frame and a plurality of transverse ribs, which are connected to the rectangular frame and are arranged transversely, and a plurality of reception wires 274, which are arranged antero-posteriorly on the support wire member 272 and are coupled thereto.

Since the support wire member 272 is constituted by a wire having a diameter larger than the reception wires 274, the shelf 270 is able to reliably support stored objects placed thereon even when the stored objects are heavy.

Furthermore, since the shelf 270 is configured to have a wire shape, cold air, which is transferred to the support plate 250 from the refrigerant pipe of the evaporator 200, is efficiently transferred to stored objects placed on the shelf 270.

In addition, since the reception wires 274 are made of wires having a relatively smaller diameter, the contact area between the stored objects and the reception wires 274 is reduced, thereby more efficiently preventing the stored objects from sticking thereto.

As shown in FIGS. 9 and 11, the support plate 250 preferably includes a plurality of support holders 254, which extend downward from the lower surface thereof to support the refrigerant pipe.

Although the support holders 254 may simply extend downward from the lower surface of the support plate 250, it is preferable that the support plate 250 be cut to define holder holes 25, in each of which the cut portion is left in a partially uncut state and bent downward so as to configure the support holders 254.

The reason for this is because cold air generated from the refrigerant pipes is efficiently transferred to stored objects placed on the support plate 250 through the holder holes 256.

Furthermore, since the cut portions of the holder holes 256 constitute the support holders 254, the support holders 254 are easily configured on a metal plate.

Each of the support holders 254 includes a pair of holder parts, which wrap and hold both lateral sides of a corresponding one of the horizontal sections 210 of the evaporator 200.

The pair of holder parts of the support holder 254 may be spaced apart from each other at ends thereof.

Since the pair of holder parts of the support holder 254 are made of a metal plate, the holder parts may be elastically deformed.

Consequently, by pressing the plurality of support holders 254 onto the horizontal section 210 of the evaporator 200, the refrigerant pipe may be inserted into the pair of holder parts of the support holder 254 while the pair of holder parts are deformed outward so as to receive the refrigerant pipe.

The refrigerant pipe mounted on the support plate 250 is maintained in the state of being suspended from the support plate 250 without contacting the lower rail 130.

Consequently, none of the load of stored objects is transferred to the refrigerant pipe of the evaporator 200.

As shown in FIGS. 8 and 9, the shelf 270 may further include a decorative member 275, which is coupled to the front end of the shelf 270 so as to surround the front end and is supported at both ends thereof by the lower rails 130.

Since the decorative member 275 is thicker than the shelf 270 so as to surround the front end of the shelf 270, the shelf 270 can be easily drawn by grasping and pulling the decorative member 275.

Finally, the mounting structure between the drawer 160 and the support plates 250, disposed on and under the drawer 160, will now be described with reference to FIGS. 2 and 13.

As shown in FIG. 2, the freezing compartment 110 is provided at the upper part thereof with the pair of drawer guides 170 for slidably supporting the drawer 160, and is provided above and below of the pair of drawer guides 170 with two pairs of lower rails 130, respectively, such that the two pair of lower rails 130 are spaced apart from each other by a predetermined distance.

As shown in FIG. 13, the drawer 160 may be provided at both lateral sides thereof with guide ribs 164, which are supported by the drawer guides 170, and may he provided at the front surface thereof with a handle groove 162.

The two pair of lower rails 130 may support two support plates 250 disposed on and under the drawer 160, and first and second support brackets 190 and 195 may further be mounted in front of the two support plates 250 so as to block the front ends of the respective support plates 250 and support the front ends of lower surfaces of the respective support plates 250.

The first support bracket 190, which is disposed under the drawer 160, may be coupled at both ends thereof to the front ends of the drawer guides 170, respectively, by means of two screws.

The first support bracket 190 is configured to support end of the support plate 250, which is disposed under the drawer 160.

The second support bracket 195 is coupled to both lateral side surfaces of the freezing compartment 110 in front of the uppermost pair of lower rails 130 and the ceiling surface of the freezing compartment 110 by means of screws.

The second support bracket 195 also functions to support the front end of the support plate 250, which is disposed on the drawer 160.

The drawer 160 is provided at the upper ends of the lateral sides thereof with stop protrusions 166 such that, when the drawer 166 is drawn, die stop protrusions 166 are caught by lower regions of opposite ends of the second support bracket 195, thereby limiting the outermost position to which the drawer 160 can be pulled.

When it is intended to completely remove the drawer 160, after the drawer 160 is drawn forward until the stop protrusions 166 catch on the second support bracket 105, the front part of the drawer 160 is pushed slightly down to release the caught state, and is drawn forward again.

Mode for the Invention

Various embodiments have been described in the best mode for carrying out the invention.

INDUSTRIAL APPLICABILITY

The present invention provides a refrigerator that is constructed to eliminate the difference in pressure between the inside and outside of the refrigerator when the door is opened, thereby making it easy to open the door and removing frost accumulated in a pressure regulator.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A refrigerator comprising:

a cabinet;

a storage compartment defined in the cabinet;

a door coupled to the cabinet so as to open and close the storage compartment; and a pressure regulator mounted at a predetermined position on the cabinet so as to allow an inside of the storage compartment to communicate with an outside of the storage compartment to reduce a difference in pressure upon opening the door, wherein the pressure regulator comprises:

a connecting tube mounted at the position on the cabinet;

an air introduction tube, which is connected to the connecting tube outside of the cabinet;

an opening portion provided inside the air introduction tube and configured to open and close the air introduction tube according to an opening and closing of the door; and a heater disposed around the connecting tube so as to heat the connecting tube to thus eliminate frost generated on an inner surface of the connecting tube, wherein the air introduction tube comprises a tube body provided outside the outer case, wherein the opening portion comprises:

a valve cap which is fitted into the tube body and includes a communication hole;

a guide shaft extending upward from a center of the valve cap; and a shutter which is configured to be moved along the guide shaft so as to selectively open and close the communication hole, and wherein the valve cap includes a plurality of hooks which extend from an edge of an upper end of the valve cap and catch in grooves formed in an inner surface of the tube body.

2. The refrigerator according to claim 1, wherein the heater is disposed to surround an outer surface of the connecting tube.

3. The refrigerator according to claim 2, wherein the connecting tube is mounted such that one end of the connecting tube that is outside of the cabinet is positioned at a higher level than the other end of the connecting tube that is inside of the cabinet.

4. The refrigerator according to claim 1, wherein the cabinet comprises:

an outer case defining an appearance of the refrigerator;

an inner case, which is coupled to the outer case and has the storage compartment therein; and a thermal insulator disposed between the outer case and the inner case, wherein the connecting tube is mounted so as to be buried in the thermal insulator.

5. The refrigerator according to claim 4, wherein the connecting tube comprises:

a first flange, which is provided at one end of the connecting tube and is supported by an outer surface of the inner case; and a second flange, which is provided at the other end of the connecting tube and is supported by an inner surface of the outer case.

6. The refrigerator according to claim 5, wherein the connecting tube further comprises a rotatable member, which is rotatably coupled to the first flange such that the rotatable member is spaced apart from an outer surface of the first flange and the inner case is disposed between the rotatable member and the first flange.

7. The refrigerator according to claim 6, wherein the connecting tube further comprises a coupling member, which is coupled to the first flange in a state of being spaced apart from the outer surface of the first flange so as to guide rotation of the rotatable member and to limit a rotating angle of the rotatable member.

8. The refrigerator according to claim 1, wherein the air introduction tube further comprises a tube flange, which is fixedly coupled to the second flange outside the outer case by means of a fastening member penetrating the outer case.

9. The refrigerator according to claim 1, further comprising a drawer slidably mounted in an upper part of the storage compartment, wherein the pressure regulator is disposed behind the drawer.

10. The refrigerator according to claim 1, further comprising:

a shelf guide provided on an inner surface of the storage compartment;

a support plate supported by the shelf guide; and a refrigerant pipe that forms an evaporator and is supported by a bottom of the support plate, wherein the support plate further comprises:

a plurality of holes that penetrate a top surface of the support plate; and a plurality of support holders which extend downward from a lower surface of the support plate to support the refrigerant pipe, wherein the plurality of support holders are formed by portions of the support plate, wherein the plurality of holes are formed by cutting portions of the support plate, and wherein the plurality of support holders are formed by bending the cut portions of the support plate produced when the plurality of holes are formed.

11. The refrigerator according to claim 10, further comprising a shelf mounted on the support plate, wherein the support plate includes lateral side supports which extend downward from both lateral side edges of the support plate to surround the refrigerant pipe and which are supported by the shelf guide.

12. The refrigerator according to claim 11, wherein the shelf guide comprises:

a pair of lower rails for supporting lower surfaces of the lateral side supports of the support plate; and a pair of upper rails for supporting an upper surface of the shelf.

13. The refrigerator according to claim 12, wherein the shelf guide further comprises a rear rib which is provided on a rear surface of the storage compartment so as to support the support plate.

14. The refrigerator according to claim 13, wherein the shelf includes a core member, which is prepared by bending and welding a metal wire, and a coating material applied to an outer surface of the core member.

* * * * *